US006230785B1

(12) United States Patent
Tokuyama et al.

(10) Patent No.: US 6,230,785 B1
(45) Date of Patent: May 15, 2001

(54) ELECTRICALLY-DRIVEN CLOSURE APPARATUS FOR BUILDING

(75) Inventors: Noriaki Tokuyama; Yoshihiro Otsuka, both of Tokyo (JP)

(73) Assignee: Sanwa Shutter Corporation, Tokyo (JP)

( * ) Notice: Subject to any disclaimer, the term of this patent is extended or adjusted under 35 U.S.C. 154(b) by 0 days.

(21) Appl. No.: 09/280,709

(22) Filed: Mar. 30, 1999

(30) Foreign Application Priority Data

Nov. 16, 1998 (JP) ..... 10-325474

(51) Int. Cl.[7] ..... A47G 5/02
(52) U.S. Cl. ..... 160/310; 160/189; 160/133
(58) Field of Search ..... 160/133, 310, 160/291, 189, 311, 312, 8; 318/466, 467, 468, 469, 470, 280

(56) References Cited

U.S. PATENT DOCUMENTS 4,827,199 * 5/1989 Kaucic et al. ..... 318/466
6,125,907 * 10/2000 Tokuyama et al. .

FOREIGN PATENT DOCUMENTS 10-82261 3/1998 (JP) .

* cited by examiner

*Primary Examiner*—Blair M. Johnson
(74) *Attorney, Agent, or Firm*—Arent Fox Kintner Plotkin & Kahn, PLLC

(57) ABSTRACT

An electrically-driven closure apparatus for building includes a shutter curtain, a driving device for driving the shutter curtain to open and close an opening, a load detecting spring disposed between the driving device and a fixed member or the frame, and sensors for detecting the rotation of the driving device. The driving device is supported rotatably around the axis of the extending shaft in accordance with load variation. The load detecting spring is slidably fixed by a spring fixing member. Thus, the spring fixing member can be used also as an adjustment member for adjusting the spring constant.

9 Claims, 19 Drawing Sheets

ELECTRICALLY-DRIVEN CLOSURE APPARATUS FOR BUILDING

BACKGROUND OF THE INVENTION

1. Field of the Invention

The present invention relates to an electrically driven closure apparatus for architectures, such as an electrically-driven shutter of a building.

Generally, a closure apparatus having an electric motor to drive a closure member for opening and closing, for example, an entrance of a building has a risk of being jammed with an obstacle when being operated to close. Therefore, the apparatus preferably has an obstacle detector and an automatic stop controller that automatically stops the closure member when the obstacle detector detects the obstacle. Two types of the obstacle detector are known: one is a direct detecting type that detects an obstacle by a detecting sensor such as a seat plate switch provided on the closure member; the other is an indirect detecting type that detects an obstacle indirectly by detecting load variation or torque variation of the electric motor when the closure member is blocked by the obstacle. The indirect type detector has an advantage in that the closure member is not required to have an obstacle sensor and that the obstacle detector can also serve as a limit detector. Conventionally, the indirect type obstacle detector may detect the load variation in accordance with a variation of a rotation speed or an electric current value (or a voltage value). However, a general electric closure apparatus utilizes an electric motor working within a range where the variation of the rotation speed due to the load variation is small, so as to obtain a stable opening and closing speed. Therefore, there is a problem that the variation of the motor speed is small when the closure member is resisted by an obstacle. A problem experienced with the current detecting type is that the electric current can be varied by a disturbance rather than by the load variation. Thus, the above-mentioned detectors have difficulty in detecting an obstacle with high accuracy and good compatibility between detection sensitivity and operation stability.

In order to solve the above-described problem, a mechanism has been proposed which can perform stable opening and closing operation while detecting an obstacle accurately. In this mechanism, an electric motor or a driving device serves as a displaceable member that changes its position in accordance with the load variation. The displaceable member is supported by a load detecting spring (a neutral position keeping spring) that keeps, under a predetermined load, the displaceable member at a neutral position with respect to a fixed member that is fixed to a frame. A displacement sensor detects change in the position of the displaceable member against the load detecting spring.

However, the conventional load detecting spring mentioned above has substantially a U-shape with one end connected to the displaceable member and the other end connected to the fixed member. When the displaceable member changes the position against the spring constant between the both ends, the position change is detected by the displacement sensor. By changing the effective length of the load detecting spring, the spring constant can be changed so as to adjust the accuracy of detection of an obstacle. In this case, the spring constant of the conventional load detecting spring is adjusted by slidably attaching an adjustment member to the parallel portions of the U-shaped spring, so that the curved portion of the spring between the fixed points becomes ineffective. Therefore, the load detecting spring must have effective length large enough to provide the required spring constant and additional length for permitting attaching of the adjustment member. Moreover, the adjustment member must be attached so as not to allow twisting or deflection of the parallel portions of the spring. Thus, the load detecting spring as well as the adjustment member tends to become large.

SUMMARY OF THE INVENTION

An object of the present invention is to provide an electrically-driven closure apparatus for a building that can solve the above-described problems.

To this end, according to the present invention, there is provided an electrically-driven closure apparatus for building, comprising: a closure member for opening and closing an opening in a building structure; a driving device having an electric motor, said closure member being opened and closed by a driving force of the driving device; the motor or the driving device being designed to serve as a displaceable member that changes rotational position relative to a fixed member fixed to the building structure, in accordance with a variation in the load; a load detecting spring disposed between the displaceable member and the fixed member; and a displacement sensor for detecting displacement of the displaceable member against the spring force of the load detecting spring, wherein the load detecting spring is fixed in the state where spring constant is adjustable.

More specifically, since the displacement of the displaceable member is substantially proportional to the motor load or reacting torque, the motor load can be detected directly by the displacement sensor. As a result, higher accuracy can be obtained in the load detection than in the conventional method where the motor load is detected indirectly from variation of rotation speed or current value. In addition, adjustment of spring constant ensures high accuracy of the obstacle detection, as well as limit detection. Moreover, a fixing member for fixing the load detecting spring can be used as the spring constant adjusting member, so that reduction of the number of components and simplification of the structure can be achieved.

Preferably, the load detecting spring of the present invention is formed substantially in U-shape or linear shape.

The displaceable member of the present invention can be structured such as to be pivoted to the motor shaft and able to rotate around the axis of the motor shaft. Rotational displacement of the displaceable member in accordance with the load variation can be detected by the displacement sensor.

Furthermore, the displaceable member of the present invention can be structured such as to be pivoted to the fixed shaft and able to rotate around the axis of the fixed shaft. Rotational displacement of the displaceable member in accordance with the load variation can be detected by the displacement sensor.

DESCRIPTION OF THE PREFERRED EMBODIMENTS

Figure 1:
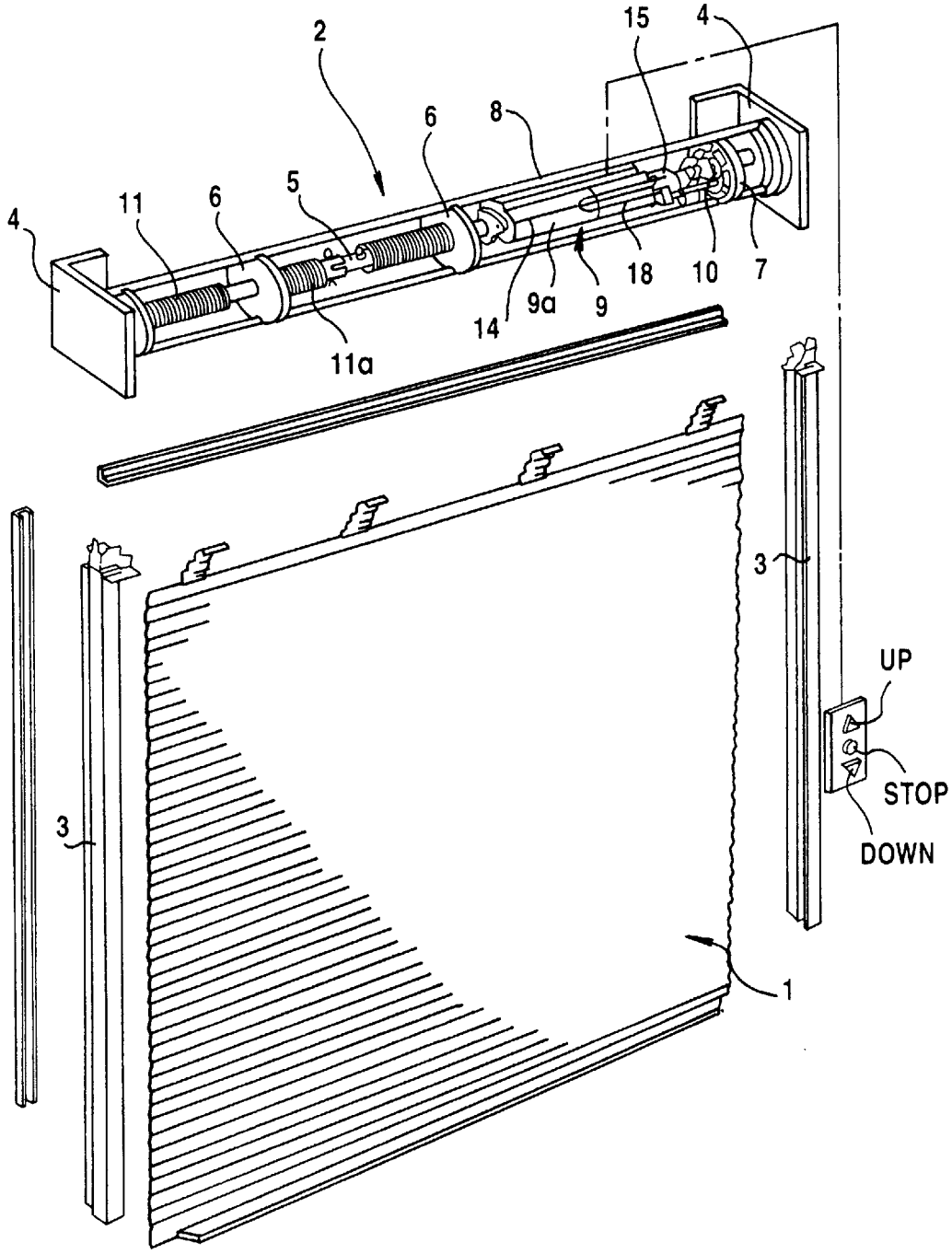
FIG. 1 is an exploded perspective view of an electrically-driven shutter for a building, as an embodiment of the electrically-driven closure apparatus of the present invention.
Figure 2:
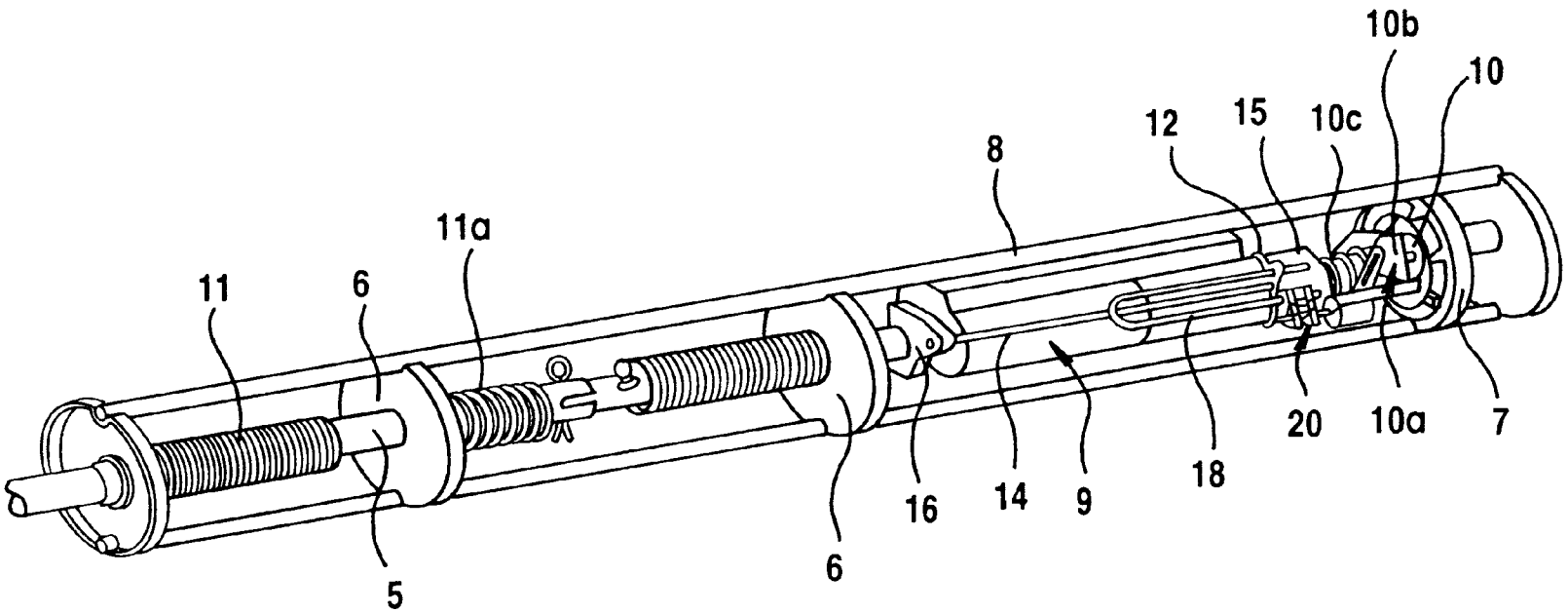
FIG. 2 is a perspective view of a take-up drum.
Figure 3B:
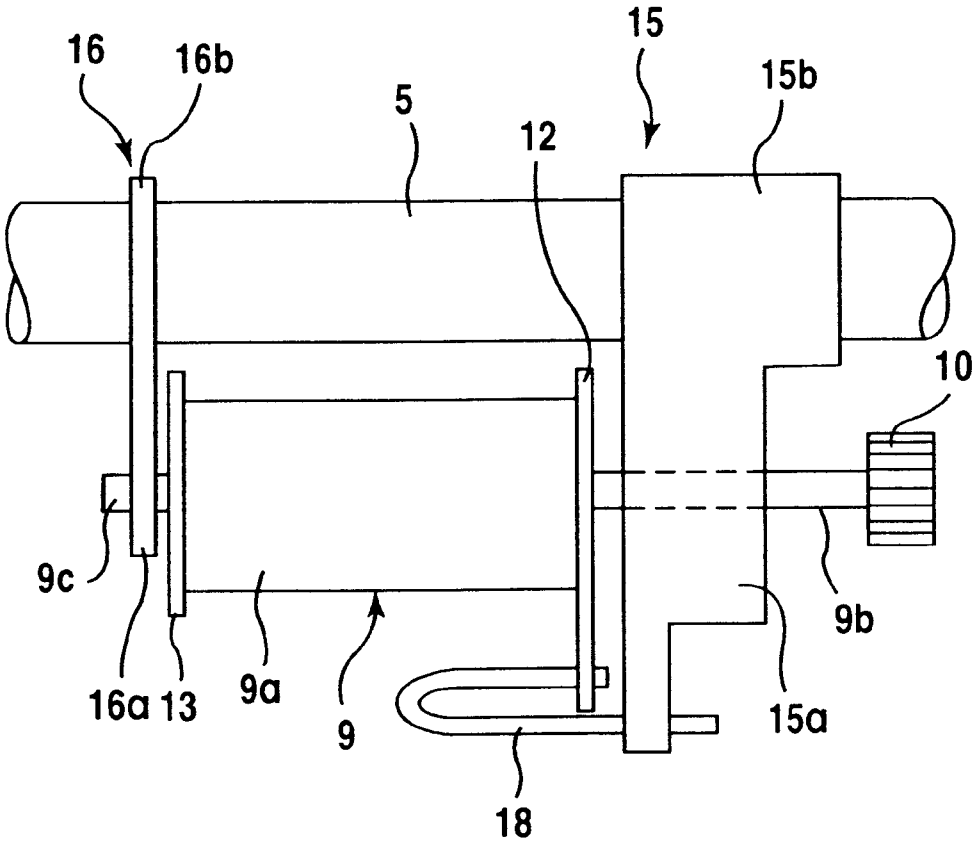
FIG. 3B is a schematic partial front view of the shutter.
Figure 3A:
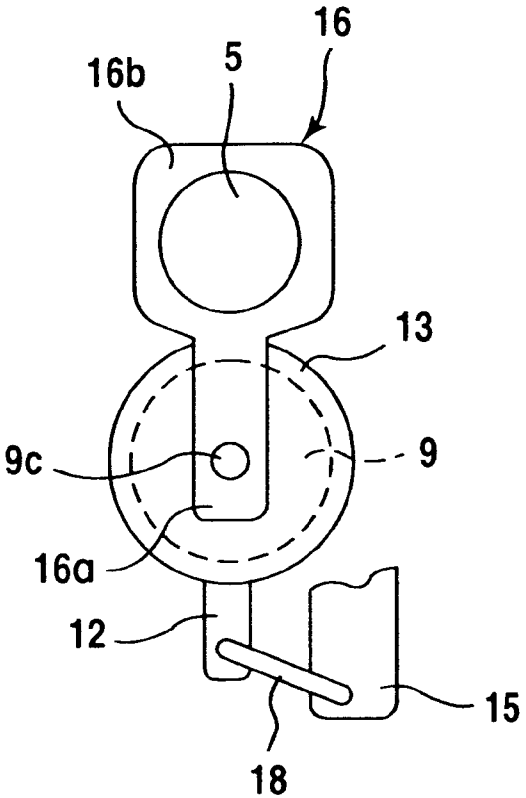
FIG. 3A is a schematic side view of the shutter.
Figure 4:
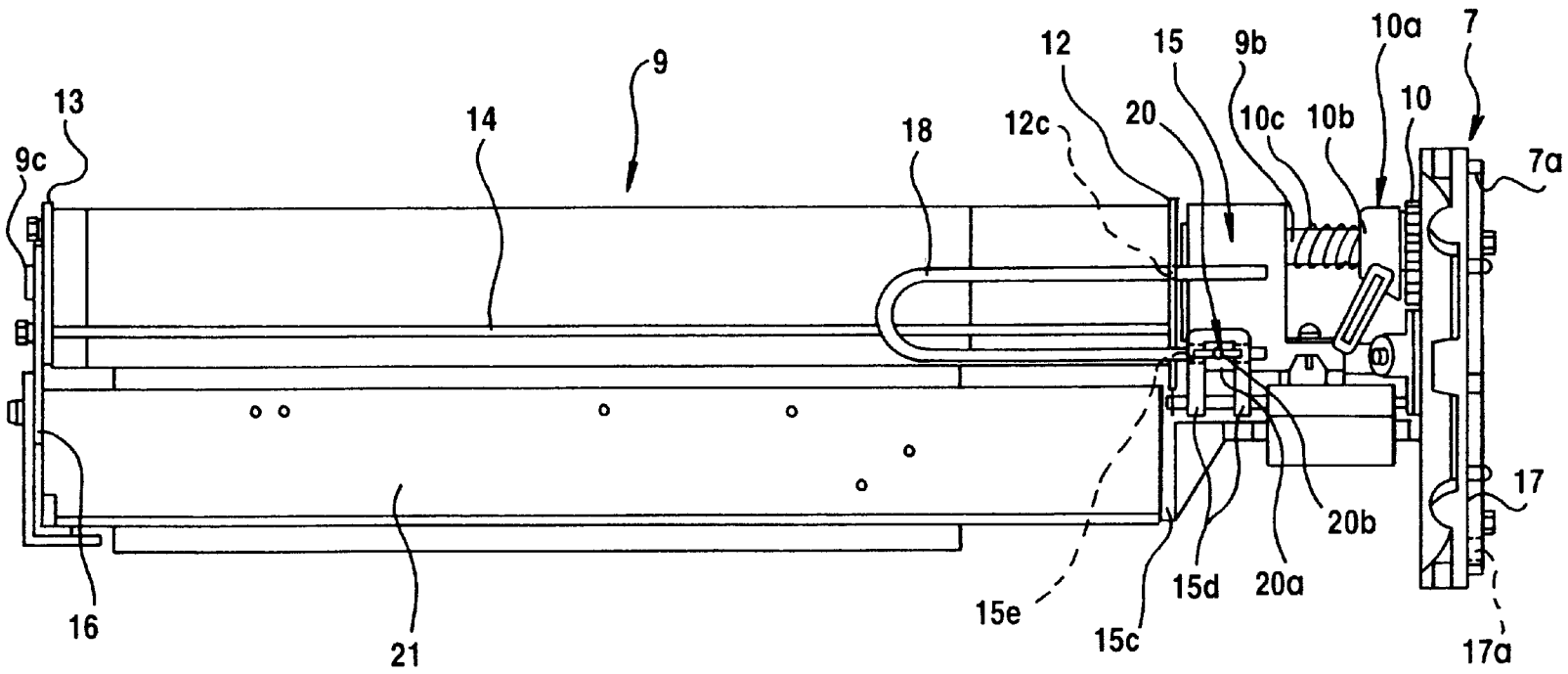
FIG. 4 is a front view of the driving device.
Figure 5:
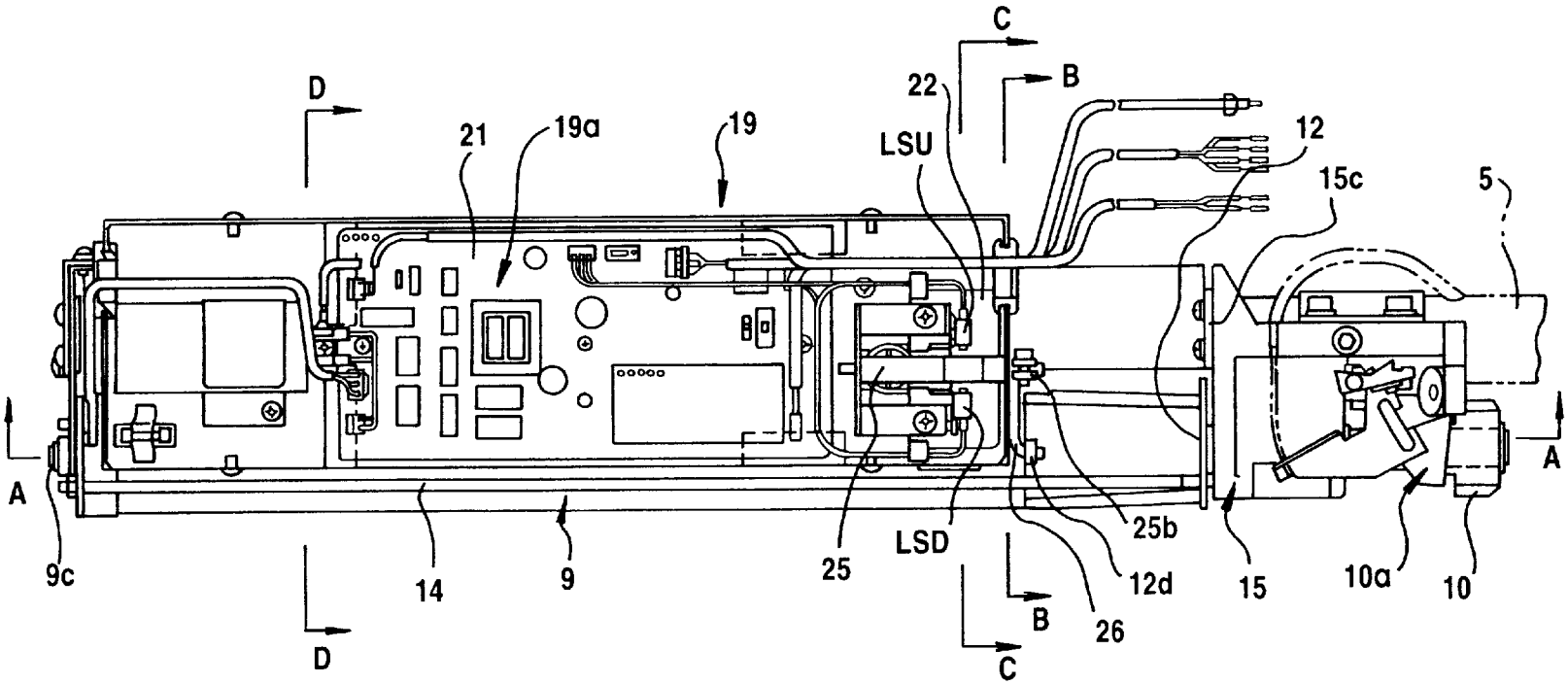
FIG. 5 is an upper rear view of the driving device.
Figure 6:
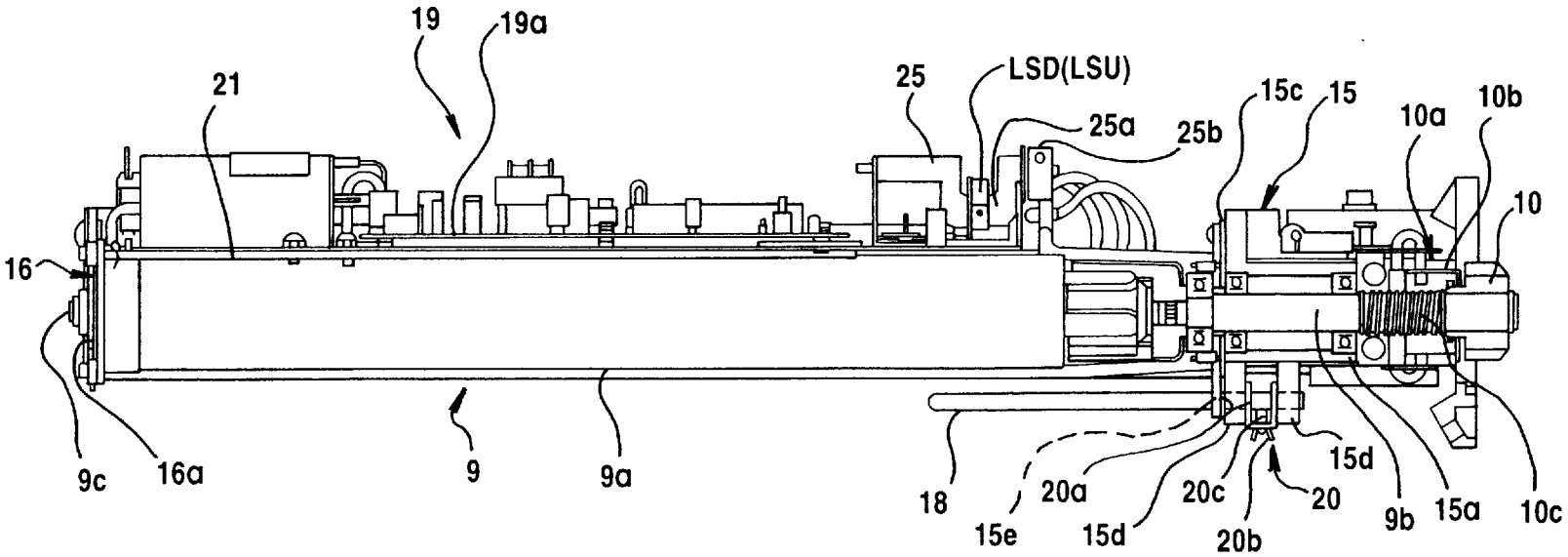
FIG. 6 is a cross section along A—A line in FIG. 5.
Figure 7:
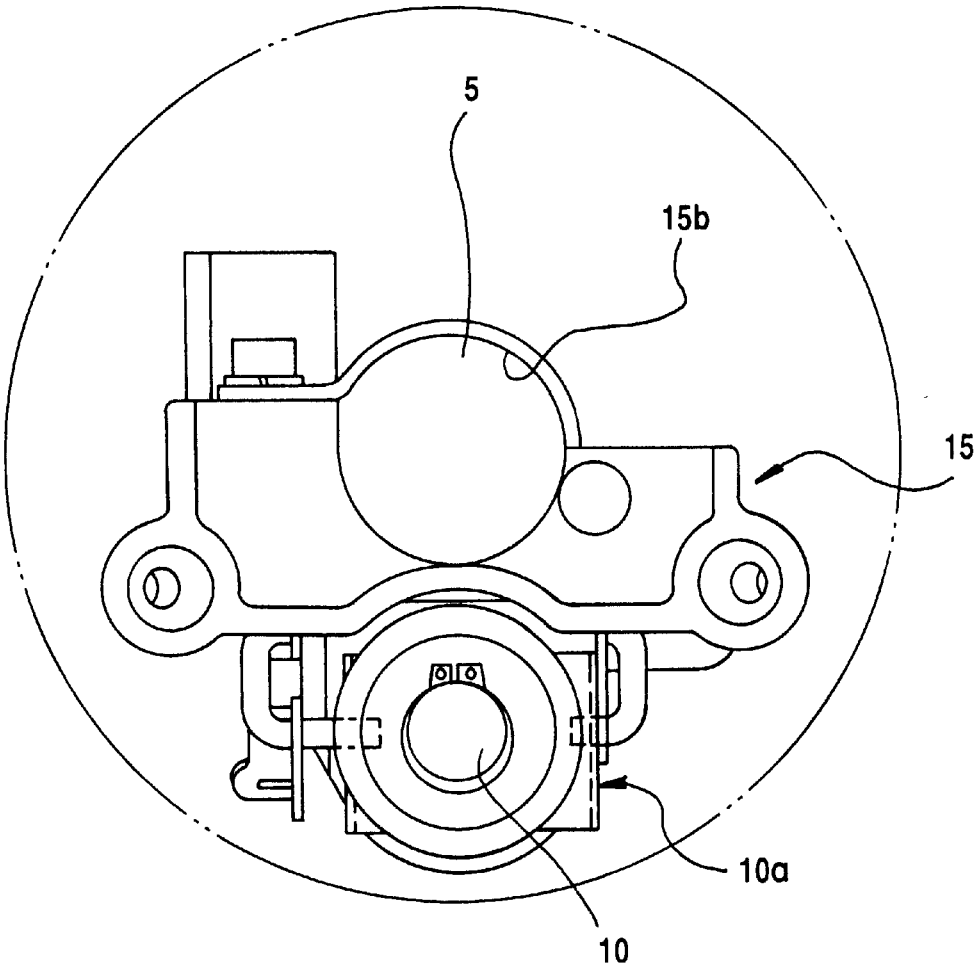
FIG. 7 is a right side view of FIG. 5.
Figure 8:
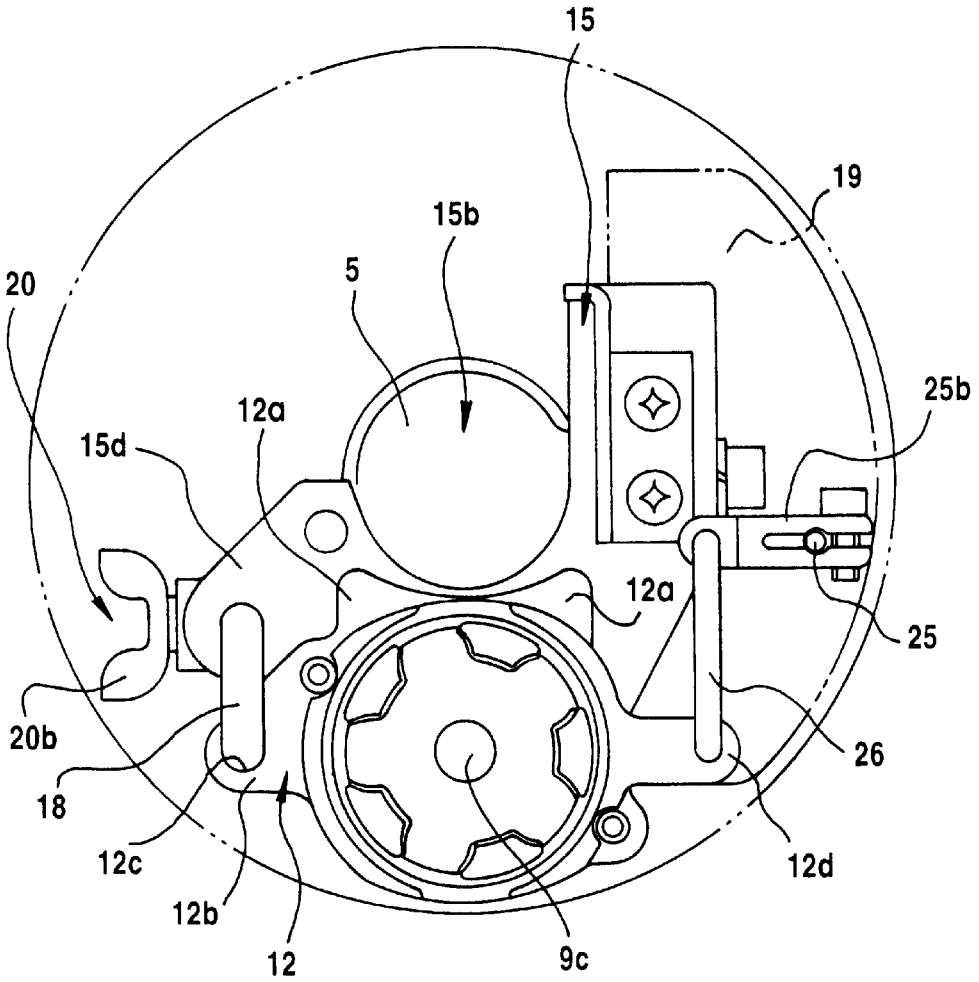
FIG. 8 is a cross section along B—B line in FIG. 5.
Figure 9:
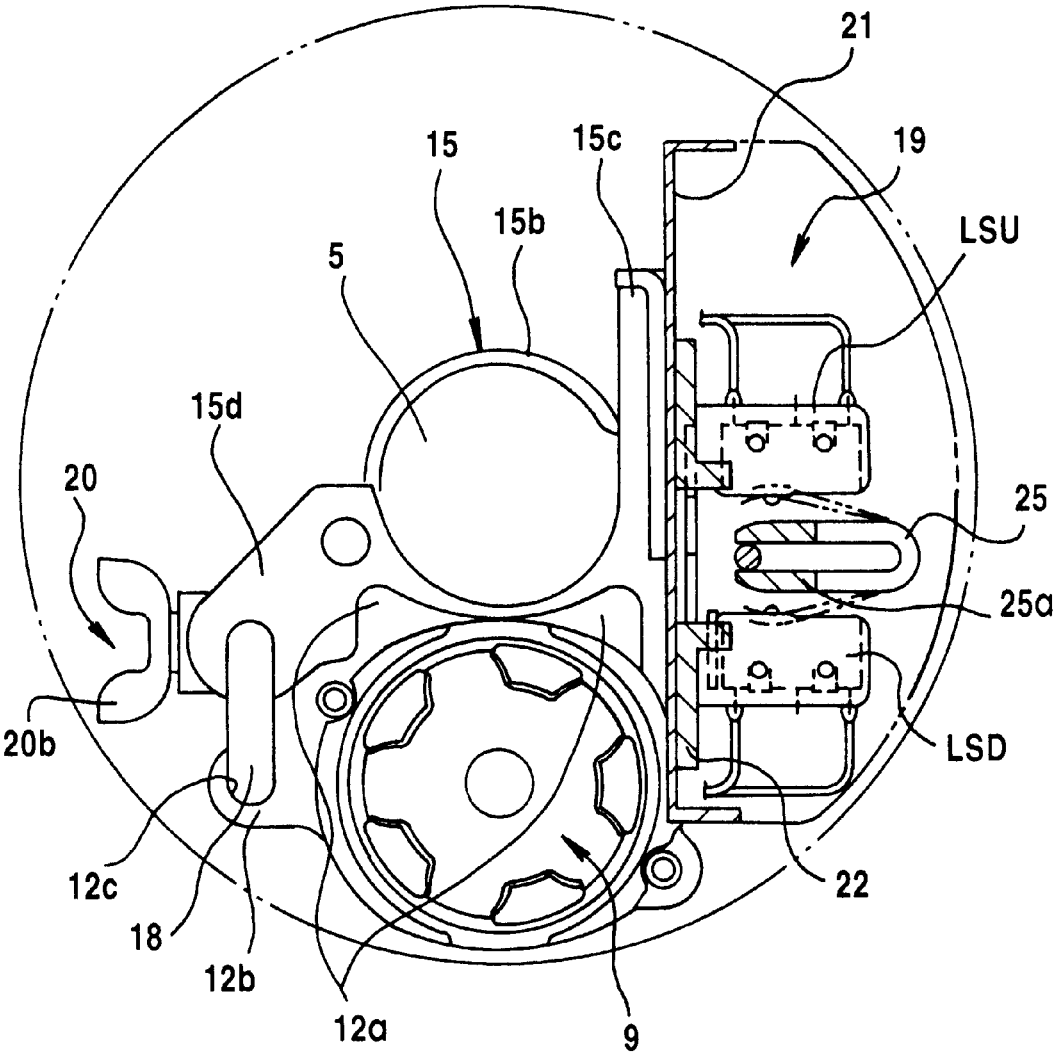
FIG. 9 is a cross section along C—C line in FIG. 5.
Figure 10:
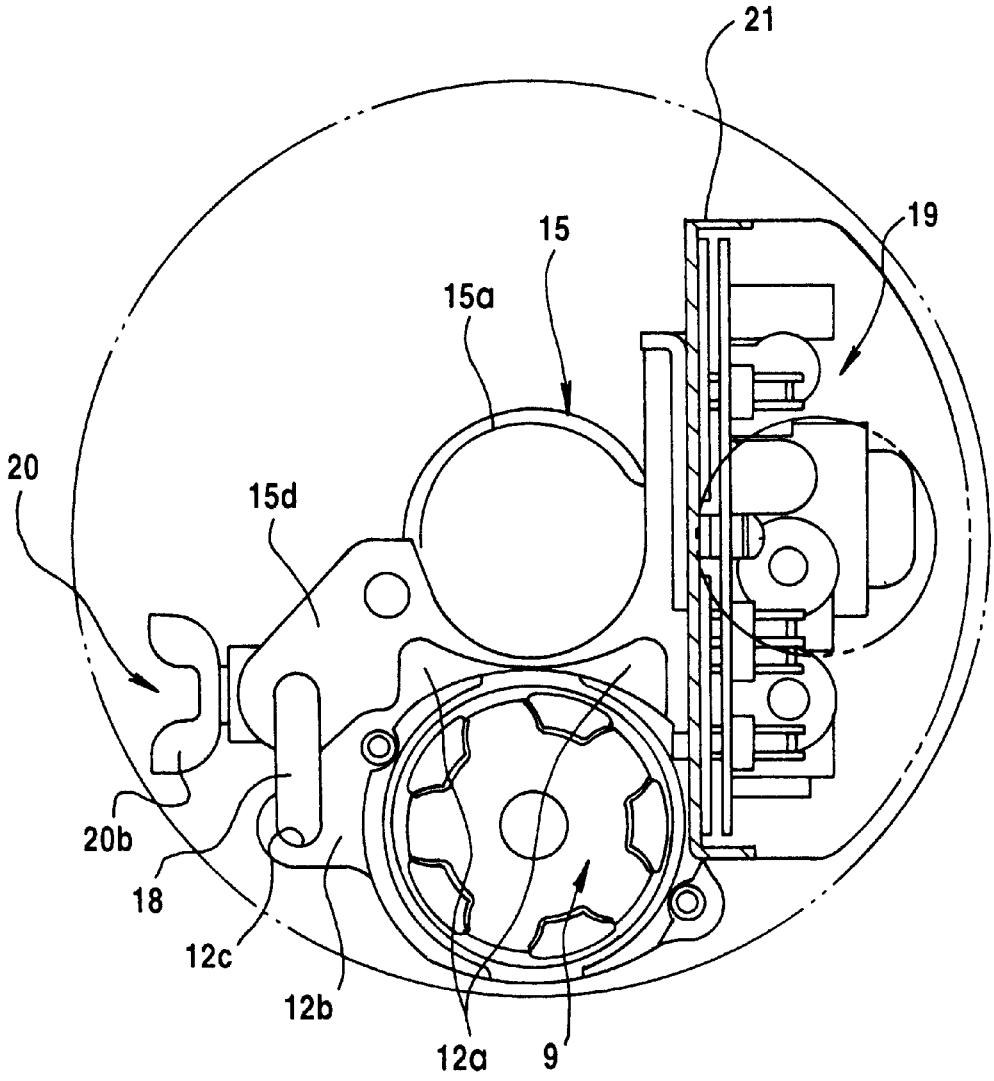
FIG. 10 is a cross section along D—D line in FIG. 5.
Figure 11:
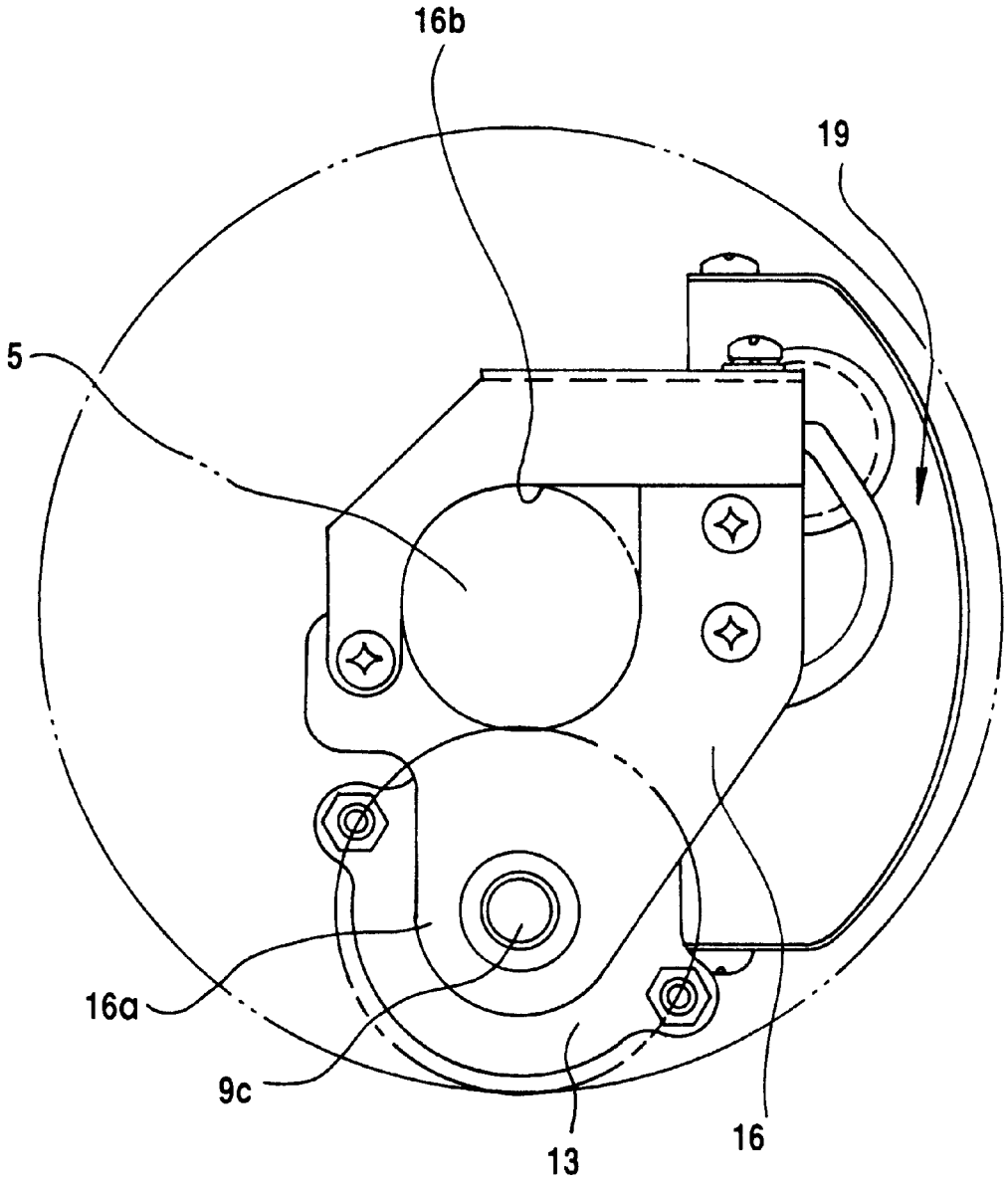
FIG. 11 is a left side view of FIG. 5.
Figure 12:
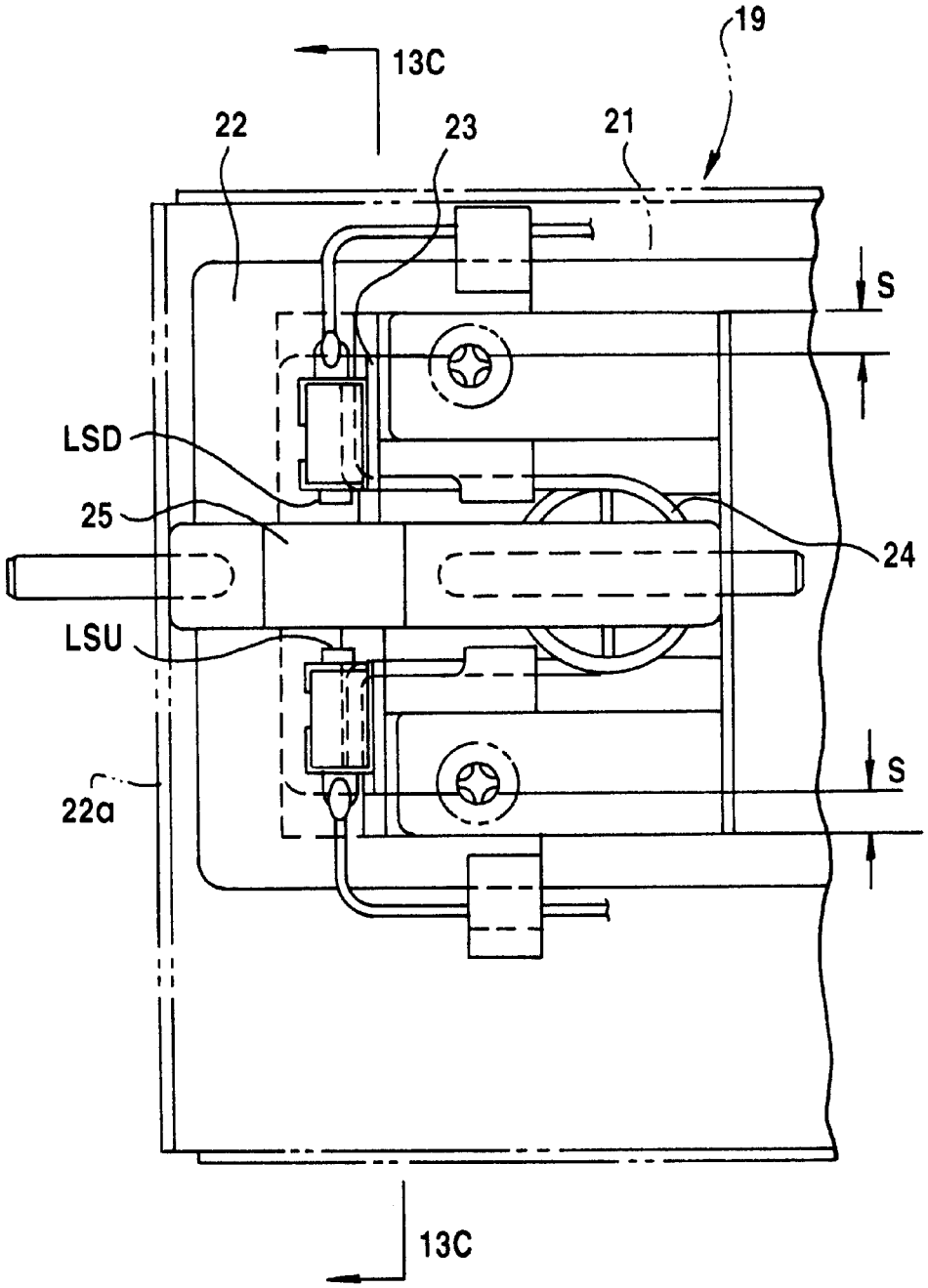
FIG. 12 is a plan view of a limit switch.
Figure 13A:
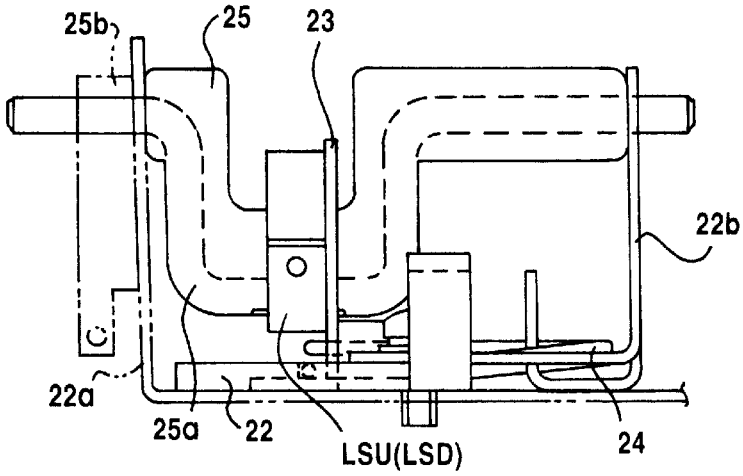
FIG. 13A is a front view of the limit switch shown in FIG. 12.
Figure 13B:
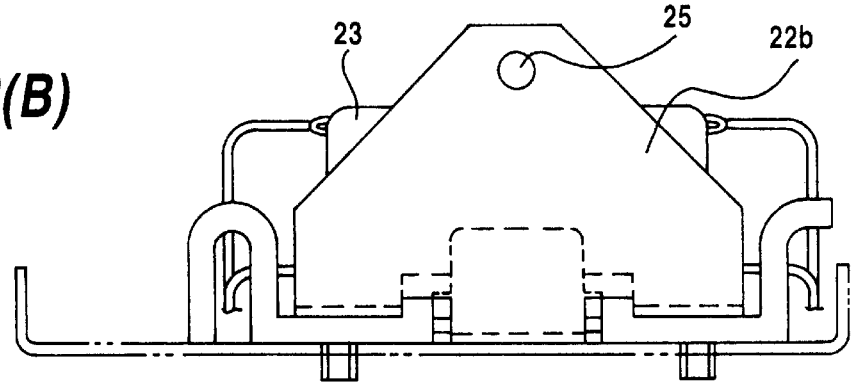
FIG. 13B is a right side view of the limit switch shown in FIG. 12.
Figure 13C:
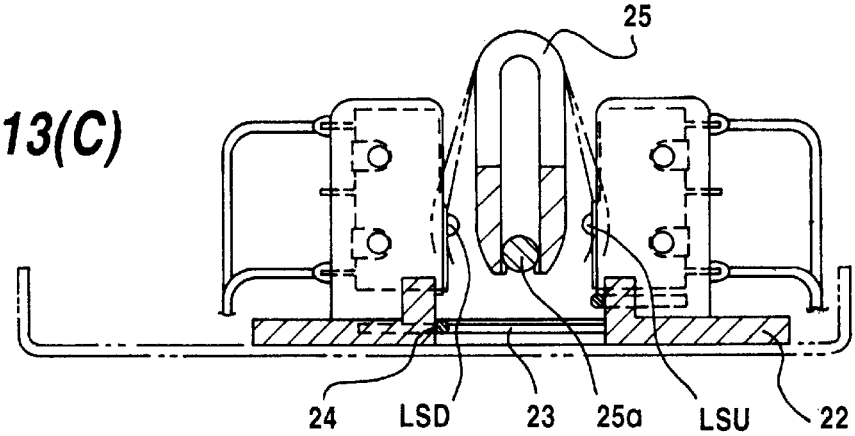
FIG. 13C is a cross section along A—A line in FIG. 12.

A first embodiment of the present invention will be described with reference to FIGS. 1 to 13.

In these figures, reference numeral 1 denotes a shutter curtain of an electrically-driven shutter for a building. The shutter curtain 1 is wound around a take-up drum 2 that will be explained below, when it is in the opening position, while it is unwound from the take-up drum 2 when it is in the closing position. This structure is the same as that of conventional shutters. Numeral 3 denotes guide rails that are disposed vertically at right and left sides of the opening to guide the right and left sides of the shutter curtain 1.

The take-up drum 2 includes a fixed shaft 5 that is fixed between a pair of brackets 4, 4 disposed at an upper portion of the frame, a plurality of wheels 6 disposed rotatably around the fixed shaft 5, an internally-toothed ring gear 7, and a stay 8 that connects the wheels 6 and the internally-toothed ring gear 7 integrally. In this embodiment, the internally-toothed ring gear 7 is disposed at one end of the fixed shaft 5. At one end of the fixed shaft 5, a driving device 9 is also attached. This driving device 9 has an electric motor of an inner drum type. The driving device 9 has an output shaft (a motor shaft) 9*b* extending from an end of the cylindrical casing 9*a*. An output gear (pinion gear) 10 is disposed integrally with the end portion of the extending output shaft 9*b*. The output gear 10 is engaged with the internally-toothed ring gear 7 so that the driving force of the driving device 9 is transmitted to the take-up drum 2. Between the fixed shaft 5 and the winding wheels 6, a balance spring 11 and a cushion spring 11*a* are disposed. The arrangement is such that the shutter curtain 1 is opened or closed while a differential between weight of the shutter curtain 1 varying in accordance with the position of the shutter curtain 1 and the force of the balance spring 11 is compensated by the driving force of the driving device 9.

Power transmission between the output gear 10 and the internally-toothed ring gear 7 is performed via a clutch 10*a*, which includes a working member 10*b* that moves the output gear 10 provided on the extending output shaft 9*b* in the axial direction, and a forcing device 10*c* that forces the output gear 10 into engagement with the internally-toothed ring gear 7. By retracting the output gear 10 against the force of the forcing device 10*c*, the output gear 10 and the internally-toothed ring gear 7 are disengaged from each other to terminate power transmission.

Numerals 12 and 13 denote first and second holders that are attached to both ends of the casing 9*a*. The first and second holders 12, 13 are connected integrally via a stay 14. The extending output shaft 9*b* rotatably extends from the first holder 12, while a rear extending shaft (a motor shaft) 9*c* rotatably extends from the second holder 13. Numerals 15 and 16 denote first and second brackets. Bearing portions 15*a*, 16*a* and fixed shaft attachment portions 15*b*, 16*b* are formed integrally on the first and second brackets 15, 16. Extending portions of the extending output shaft 9*b* and the rear extending shaft 9*c* are pivoted to the bearing portions 15*a*, 16*a*, while the fixed shaft 5 is fixed to each of the fixed shaft attachment portions 15*b*, 16*b*. Thus, the driving device 9 (the first and second holders 12, 13) are supported for pivotal motion about the axis of the motor shaft with respect to first and second brackets 15, 16 (fixed shaft 5).

Numeral 12*a* denotes a pair of stoppers provided on the first holder 12. The stopper 12*a* abuts the fixed shaft 5 to stop the rotation of the first holder 12 when the same has rotated together with the driving device 9 by a certain large angle (e.g., ±12 degrees). Thus, the permissible rotation range of the driving device 9 is restricted.

Numeral 17 denotes a guide plate which is integrally attached to the first bracket 15 and which is received in the internally-toothed ring gear rotatably, and numeral 17*a* denotes a guide roller that engages with and rolls along a guide groove formed in the internally-toothed ring gear 7.

A load detecting spring 18 is connected between the first holder 12 that is the pivotable part and the first bracket 15 that is the fixed part. The load detecting spring 18 supports the pivotable driving device 9 (the first holder 12) with zero spring force at substantially middle position (±0 degree) of the permissible pivoting range, i.e., at a neutral position, under non-working state of the driving device 9 (in the neutral position). The arrangement is such that the load detecting spring 18 produces force when the driving device 9 pivots from the neutral position in forward or backward direction.

More specifically, the first holder 12 is provided with a protruding member 12*b*, through which a spring through hole 12*c* is formed. The first bracket 15 has two sides between which the fixed shaft attachment portions 15*b* are disposed. The first bracket 15 is provided at one side of the fixed shaft attachment portions 15*b* with a supporting member 15*c* for attachment of the controller 19 that will be explained below. The first bracket 15 is provided at the other side of the attachment portions 15*b* with a pair of protruding portions 15*d* at an axial distance. Each of the protruding portions 15*d* is provided with a spring through hole 15*e*. The load detecting spring 18 has end portions, each of which penetrates the spring through hole 12*c* or 15*e* formed in the first holder 12 or the first bracket 15, so as to slide. By fixing the load detecting spring 18 at an appropriate position with a spring fixing member 20, a spring force (a spring constant) corresponding to the fixed position is generated.

The spring fixing member 20 is disposed between the pair of protruding members 15*d* of the first bracket 15. The spring fixing member 20 includes a U-shaped fixing metal 20*a*, through both leg portions of which one end of the load detecting spring 18 penetrates and which is slidable between the protruding members 15*d*. The spring fixing member 20 also includes a butterfly bolt 20*b*, which penetrates the fixing metal 20*a* and move toward and away from the load detecting spring 18, the end of which is passed through the fixing metal 20*a*, and a nut 20*c* that engages with the butterfly bolt 20*b*. Rotation of the nut 20*c* is stopped by the leg portions of the fixing metal 20*a*. By rotating the butterfly bolt 20*b* relatively to the nut 20*c*, the tip of the butterfly bolt 20*b* abuts or leaves the load detecting spring 18, so that the movement of the load detecting spring 18 is restricted (i.e., the spring 18 is fixedly attached) or released.

The fixing position of the load detecting spring 18 is changeable to vary the effective length of the spring 18, thus allowing adjustment of the spring constant of the same. The position to which the load detecting spring 18 is fixed may be changed in accordance with weight of the shutter or other factors. In this case, the butterfly bolt 20*b* is loosened to become releasing position. Since the operation portion of the butterfly bolt 20*b* is exposed from the ends of the protruding portions 15*d*, the operation direction of the butterfly bolt 20*b* can easily be selected, thus facilitating the adjustment. Thus, the adjustment can be performed easily.

When the driving device 9 held in the neutral position receives a reaction torque corresponding to the motor load, the driving device 9 pivots against the load detecting spring 18 in accordance with the magnitude of the motor load. Namely, in the case where the shutter curtain 1 is blocked by an obstacle or reaches the closing limit position (grounding position), imbalance is caused between the weight of the shutter curtain 1 and the spring force of the balance spring 11. Therefore, the driving device 9 may pivot a large angle (e.g., more than +6 degrees) in a certain direction against the load detecting spring 18. Conversely, when the shutter curtain 1 reaches the opening limit position, i.e., a full-open position where the end of the curtain 1 engages with the edge of the outlet slot, tensile force is applied to the shutter curtain 1 to cause the driving device 9 to pivot largely in the other direction (e.g., −6 degrees).

In this embodiment, the maximum allowable stress of the load detecting spring 18 is set higher than the stress that is generated when the displacement of the driving device 9 is maximum. Therefore, the stress of the load detecting spring 18 is limited not to reach the maximum allowable stress, whereby the load detecting spring 18 is prevented from a destruction.

A controller 19 is attached to a controller bracket 21 that interconnect the supporting member 15*c* of the first bracket 15 and the second bracket 16 in a manner like a bridge. The controller 19 includes a shutter control circuit 19*a* and limit switches LSD, LSU that are connected to the shutter control circuit 19*a* to detect the rotational displacement of the driving device 9. The limit switches LSD, LSU are operatively connected to the driving device 9 as follows.

Namely, a fixed switch bracket 22 is disposed on a portion of the controller bracket 21 adjacent to the first bracket 15. This fixed switch bracket 22 has a sliding switch bracket 23 that can slide a predetermined distance S in the direction corresponding to the radial direction of the take-up drum 2. The limit switches LSD, LSU are fixed to the sliding switch bracket 23, leaving therebetween the predetermined distance S in the drum-radius direction. The sliding switch bracket 23 is supported and positioned at the neutral position by a torsion spring 24 disposed at the fixed switch bracket 22. Numeral 25 denotes a working lever that is disposed between the limit switches LSD and LSU. The working lever 25 is rotatably supported in a horizontal posture by the protruding portions 22*a*, 22*b* of the fixed switch bracket 22. At the middle portion of the working lever 25, an operating portion 25*a* is formed that moves into or out of contact with one of the limit switches LSD, LSU when the working lever 25 swings. The end of the working lever 25 that extends from the protruding portions 22*a* is connected to the upper end of the link rod 25*b* integrally.

An arm attachment portion 12*d* is formed in the first holder 12 at the portion that is radially adjacent to the link rod 25*b*. One end of a U-shaped working arm 26 is rotatably engaged with an engagement hole formed in the arm attachment portion 12*d*. The other end of the working arm 26 is rotatably engaged with an engagement hole formed in the lower end portion of the link rod 25*b*, which is swung by the working arm 26 when the driving device 9 changes its rotational position. Thus, the working lever 25 swings until the corresponding limit switch LSD or LSU works to stop the driving device 9.

The swinging stroke of the working arm 26 for detection of the limit switch LSD or LSU is set larger than the swing stroke generated during a normal operation without an excessive load (i.e., without any obstacle), and smaller than the swing stroke generated under the excessive load. It is therefore possible to detect extreme states such as jamming of an obstacle, the full opened state and the full closed state that cause an excessive load. In the normal operation, the rotation force generated by the swinging of the working lever 25 is smaller than the output force of the torsion spring 24 that keeps the fixed switch bracket 22 supporting the limit switches LSD and LSU in the neutral position. Thus, the limit switches LSD and LSU can perform detection while being kept in the neutral position.

On the other hand, if for an unexpected reason the driving device 9 fails to stop its operation in spite of the detection by the limit switch LSD or LSU, a load larger than the excessive load is generated and the working lever 25 applies a large rotation force above the swinging stroke to the limit switch LSD or LSU. In such a case, the sliding switch bracket 23 supporting the limit switches LSD and LSU is subjected to a force greater than the output force of the torsion spring 24. Then, the sliding switch bracket 23 slides relative to the fixed switch bracket 22. As a result, the limit switches LSD and LSU are protected from the excessive load.

The shutter control circuit 19*a* of this embodiment is designed under the following consideration. Namely, if the shutter curtain 1 is being closed under a strong wind, a large load may be applied to the shutter curtain 1, and the limit switch LSD or LSU for detecting lower or upper limit may erroneously operate. In this case, the shutter curtain 1 cannot work if trying to close it since the limit switch LSD or LSU is in operative or detecting state. In consideration of such an event, the shutter control circuit 19*a* has a manual mode to open or close the shutter curtain 1 manually even if the limit switch LSD or LSU is in operating or detecting state. If a stop switch is kept pushed for ten seconds, the normal operation mode is changed to the manual mode. In the manual mode, the shutter curtain 1 opens or closes regardless of the states of the limit switches LSD and LSU, when an open switch UP or a close switch DOWN is kept pushed. Recovery of the normal mode from this manual is performed by prohibiting all operations including open, close and stop for ten seconds.

Excessive load may be generated during start of the driving device 9. If the detection sensitivity is set not to detect the large starting load, accuracy of the obstacle detection would be impaired undesirably. Therefore, the detection by the limit switch LSD or LSU is dismissed for e.g., one second at start, so that the impairment of the detection accuracy can be avoided.

In this embodiment, a recognition mechanism is provided for recognizing the detection or non-detection state of the limit switches LSD and LSU when operating the switches. For example, a continuous beep tone is generated for the detection state, and an intermittent tone is generated for the non-detection state, though other type of mechanism may be employed as well. As described above, when the shutter curtain 1 does not work even when the UP or DOWN switch is operated, a check is made for the state of the limit switches LSD and LSU. If it is found that a trouble in the limit switch LSD or LSU has caused the shutter curtain 1 to operate, the operation mode can be changed to the manual mode after checking the state of the shutter curtain 1, so that the shutter curtain 1 can safely be opened or closed.

When the shutter curtain 1 has been fully opened, the seat plate at the lowest end of the shutter curtain 1 abuts the lintel so that the limit switch LSU detects that the upper limit position has been reached, whereby the driving device 9 stops to operate. On this occasion, there is a slight time lag between the contact of the seat plate with the lintel and the stop of the driving device 9 after detection of the limit switch LSU. Since the shutter curtain 1 tends to further open during this time lag period, the seat plate may stop giving a stress load to the lintel. Therefore, in this embodiment, the driving device 9 is operated in the closing direction (in the reverse direction) for a predetermined period after the limit switch LSU turns on, so that the shutter curtain 1 is unwound or slacked a little until a slight gap is generated between the seat plate and the lintel.

In the electrically-driven shutter having the described construction, when an excessive load is generated due to jamming of an obstacle, full opening or full closing, the driving device 9 is pivoted against the force of the load detecting spring 18, so that the limit switch LSD or LSU works to stop the driving device 9 automatically. Since the driving device 9 is supported so as to rotate in accordance with the motor load (the reaction torque), the motor load can be detected directly from the displacement of the driving device 9. Therefore, load detection with high accuracy can be achieved compared with the conventional indirect detection that relies on detection of rotation variation or current variation. Thus, the accuracy of the obstacle detection or the limit detection can be improved.

Furthermore, since the spring constant of the load detecting spring 18 is adjustable, adjustment of the detection sensitivity can be performed mechanically, so that a load detecting spring 18 can be used for different closure members having different weights. The adjustment of the spring constant of the load detecting spring 18 can be achieved by the following steps. First, the butterfly bolt 20*b*, which is disposed at the protruding portions 15*d* of the first bracket 15 for fixing the load detecting spring 18, is loosened. Then, the load detecting spring 18 is moved by sliding to a desired position. Finally, the butterfly bolt 20*b* is tightened for fixing the load detecting spring 18. Since the adjustment of the spring constant can be achieved using the spring fixing member 20 for fixing the spring 18, no special adjustment member is required for enabling adjustment of the load detecting spring 18. Thus, using the common members, the structure can be simplified and the number of components can be reduced. In addition, unlike the conventional structure having an adjustment member at parallel portion of the load detecting spring, there is no problem such as necessity of space for adjustment member on the spring. Thus, the load detecting spring 18 as an assembly can be smaller.

Furthermore, since the knob portion of the butterfly bolt 20*b* for adjusting and fixing the load detecting spring 18 is adjustable in the radial direction, operability is improved to afford easy operation.

Since the driving device 9 is supported for rotational displacement around the motor shaft axis, it is not necessary to preserve an ample space for accommodating the displacement of the driving device 9. Moreover, this embodiment can be realized by a simple structure such as modification of the first and second brackets 15, 16.

Furthermore, in this embodiment, even if overload of the limit switch LSD or LSU has grown large to an extraordinary level, the limit switch LSD or LSU is allowed to slide so as to be protected from such an abnormal load.

In addition, the rotation range, i.e., the maximum allowable displacement, of the driving device 9 is limited and the maximum allowable stress of the load detecting spring 18 is set to be greater than the stress that is applied under the maximum allowable displacement of the driving device 9. Therefore, the stress of the load detecting spring 18 is always below the maximum allowable stress, so that the breakage of the load detecting spring 18 can be avoided.

It is to be understood that the first embodiment described in the foregoing is only illustrative. For example, it is possible to support a reduction gear that makes up the driving device 9 as a displaceable member that changes the position in accordance with the load variation, so that the load variation is detected based on the displacement of the member. In addition, the present invention can be applied to other types of closure apparatus than the electrically-driven shutter of the first embodiment. For example, the present invention can be applied to a roll type curtain such as an awning.

Figure 14B:
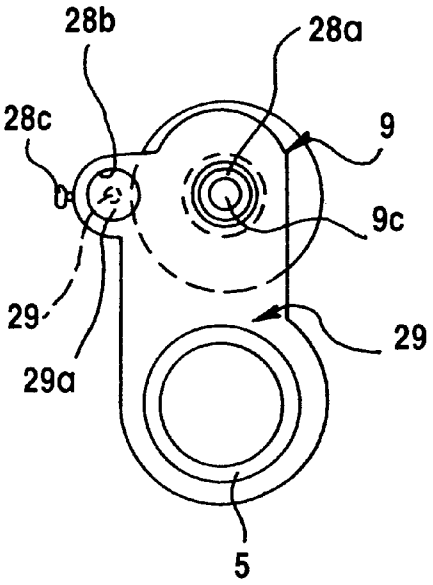
FIG. 14B is a right side view of the second embodiment of the present invention.
Figure 14A:
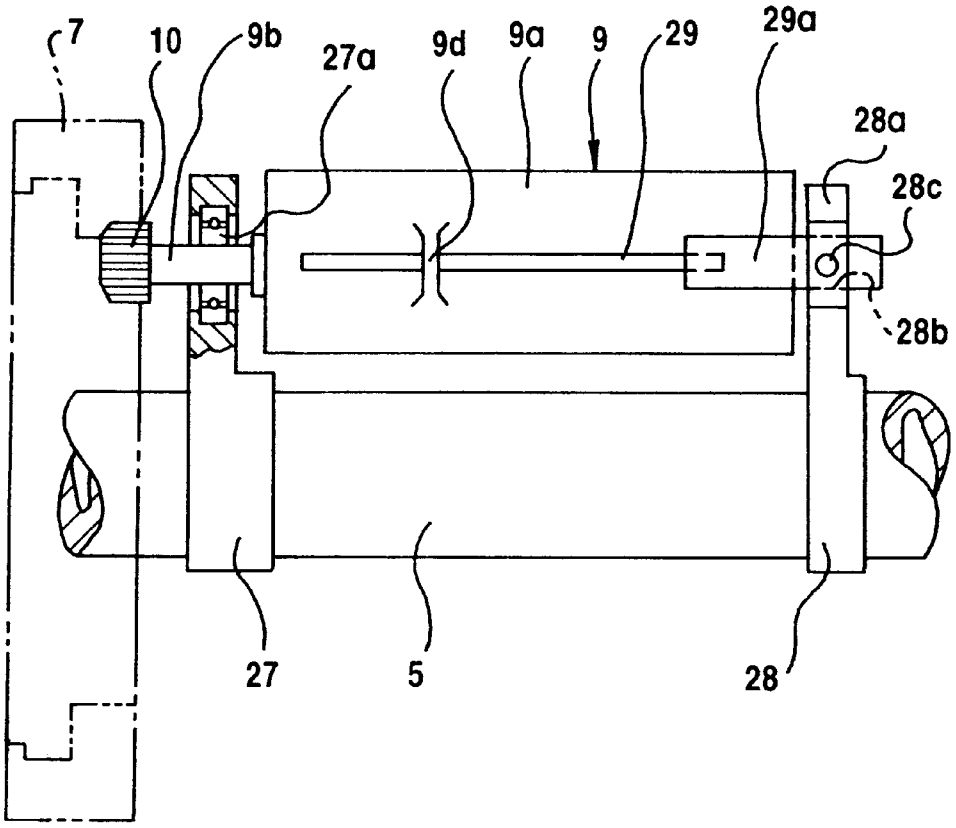
FIG. 14A is a front view of a second embodiment of the present invention.

Next, a second embodiment of the present invention will be explained with reference to FIG. 14. In this figure, the same element as in the first embodiment has the same reference numeral so as to omit the detail explanation.

In this embodiment, the first and second brackets 27, 28 fixed to and supported by the fixed shaft 5 has bearings 27*a*, 28*a*. The extending output shaft 9*b* extending from the driving device 9 and rear protruding shaft 9*c* are supported by the bearings 27*a*, 28*a*. Thus, the driving device 9 can rotate around the motor shaft axis. Numeral 29 is the load detecting spring made by linear spring steel. A casing cylinder 29*a* is engaged integrally with the outer surface of the proximal end of the load detecting spring 29. The casing cylinder 29*a* can slide axially inside the spring attachment hole 28*b* formed in the second bracket 28. Thus, the casing cylinder 29*a* can be fastened by the tip portion of a screw pin 28*c* that is screwed in the spring attachment hole 28*b*. The tip portion of the load detecting spring 29 is engaged to slide axially but not to rotate around the axis with the engaging portion 9*d* that protrude radially from the outer surface of the casing 9*a* of the driving device 9. Thus, the portion of the load detecting spring 29 between the engaging portion 9*d* and the attachment portion of the casing cylinder 29*a* at the proximal end works effectively as a spring, so that the driving device 9 is supported in the neutral position in accordance with a spring constant (spring force) based on the effective length of the load detecting spring 29.

If excessive load (rotation load) is applied to the driving device 9, the driving device 9 rotates relatively against the spring force of the load detecting spring 29, so that a limit switch (not shown in the figure) can detects the rotation movement. This mechanism is the same as the first embodiment. In this second embodiment, adjustment of the effective length of the load detecting spring 29 (i.e., adjustment of the spring constant) is performed by loosening the spring pin 28*c* in the spring attachment hole 28*b* of the second bracket 28, sliding the load detecting spring 29 to a desired position via the spring attachment hole 28*b* and the engaging portion 9*d*, and then screwing the screw pin 28. In this embodiment too, the fixing member (of the second bracket 28 side in this case) for the load detecting spring 29 can be used as the adjustment member, so that the simplification of the structure and the reduction of components can be achieved.

Figure 15B:
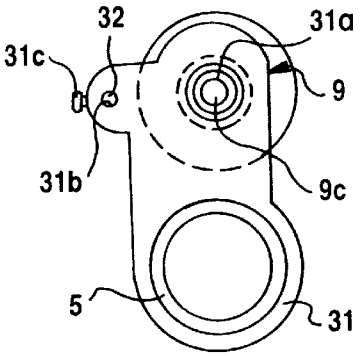
FIG. 15B is a right side view of the third embodiment of the present invention.
Figure 15C:
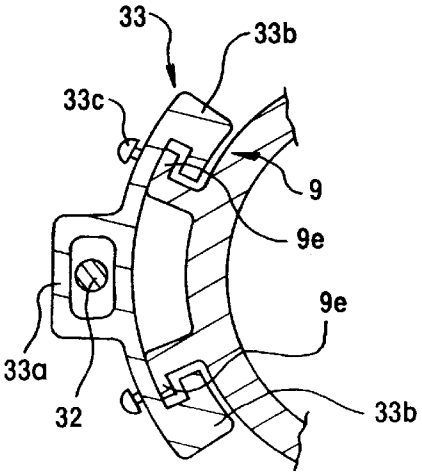
FIG. 15C is a cross section along A—A line in FIG. 15A.
Figure 15A:
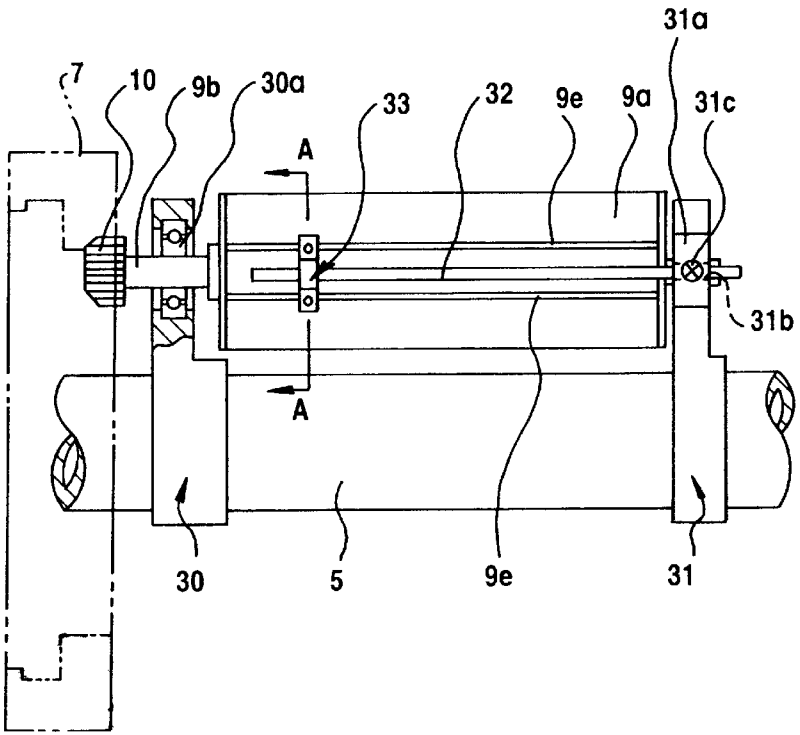
FIG. 15A is a front view of a third embodiment of the present invention.

Next, a third embodiment of the present invention will be explained with reference to FIG. 15. In this embodiment, the first and second brackets 30, 31 fixed to and supported by the fixed shaft 5 has bearings 30*a*, 31*a*. The extending output shaft 9*b* extending from the driving device 9 and rear protruding shaft 9*c* are supported by the bearings 30*a*, 31*a*. Numeral 32 is the load detecting spring made by linear spring steel similarly to the second embodiment. The proximal end of the load detecting spring 32 can slide axially inside the spring attachment hole 31*b* formed in the second bracket 31, and fixed by a screw pin 31*c*. Thus, the proximal end of the load detecting spring 32 is fixed to the second bracket 31. The load detecting spring 32 has substantially the same length as the casing 9*a* of the driving device 9. The tip portion of the load detecting spring 32 is fixed to the casing 9*a* by a fixing member 33. The fixing member has a through hole 33*a* in which the load detecting spring 32 can slide axially, and slide engagement portions 33*b* located on both sides of the through hole 33*a*. The tip portion of the load detecting spring 32 is put into the through hole 33*a*. The slide engagement portions 33*b* are put to slide along a pair of protruding portion 9*e* formed elongate axially on the outer surface of the casing 9*a*, and are engaged with stop screws 33*c*. Thus, the load detecting spring 32 is fixed to the second bracket 31 and the casing 9*a* with restricted to rotate around the outer surface.

In this embodiment, the fixing member 33 slides on the casing 9*a*, so that the effective length of the load detecting spring 32 (i.e., the spring constant) can be adjusted. Therefore, in the same manner as the second embodiment, the fixing member (of the casing 9*a* side in this case) 33 for the load detecting spring 29 can be used as the adjustment member, so that the simplification of the structure and the reduction of components can be achieved.

Figure 16B:
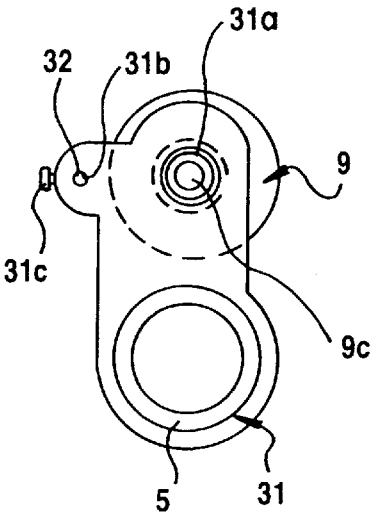
FIG. 16B is a right side view of the forth embodiment of the present invention.
Figure 16C:
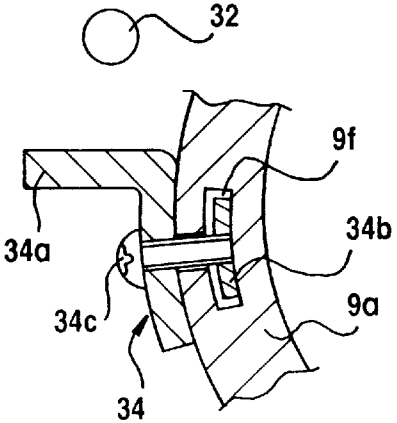
FIG. 16C is a cross section along A—A line in FIG. 16A.
Figure 16A:
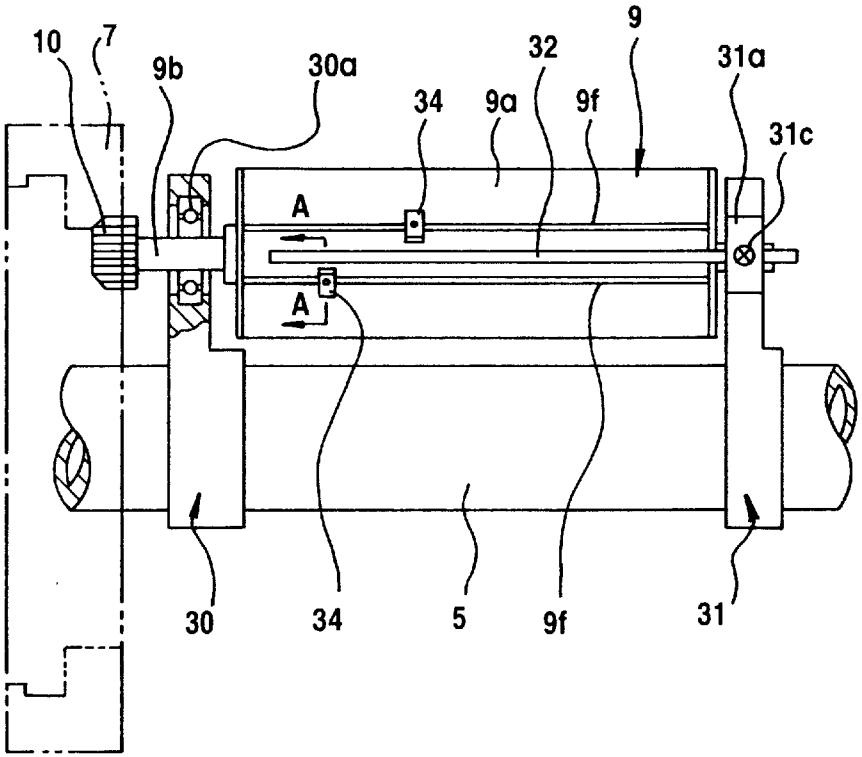
FIG. 16A is a front view of a forth embodiment of the present invention.

Next, a forth embodiment of the present invention will be explained with reference to FIG. 16. The apparatus of this embodiment includes first and second brackets 30, 31 and a load detecting spring 32. The proximal end of the load detecting spring 32 is fixed to the second bracket 31. This structure is similar to the third embodiment. Numeral 34 is a pair of engaging members disposed at both sides of circumferential direction of the load detecting spring 32. The engaging member includes an engaging portion 34*a* opposing the load detecting spring 32, and a slider 34*b* that engages an axially elongated slide groove 9*f* formed on the casing 9*a* opposing the load detecting spring 32 at both sides in the circumferential direction.

The engaging member 34 id fixed to the certain axial position of the casing 9*a* by engaging the engaging portion 34*a* with the slider 34*b* using a screw 34*c*. When the casing 9*a* rotate relatively to the second bracket 31 (in the forward or reverse direction), the load detecting spring 32 engages either of the engaging members 34, so that the rotation is restricted and spring force is generated. In this embodiment, the fixing member (of the casing 9*a* side) 34 can be used as the adjustment member for adjusting the spring constant of the load detecting spring 32, so that the simplification of the structure and the reduction of components can be achieved.

In addition, the positions of the engaging members 34 can be adjusted independently of each other, so that an appropriate detection accuracy corresponding to opening and closing of the shutter curtain 1 can be set, and good usability can be obtained.

Setting different values of the detection accuracy for opening and closing of the shutter curtain 1 can be achieved by the following method excepting the method of changing the spring constant as explained in the former embodiment.

Namely, to change the detection accuracy, the limit switches LSD and LSU of the controller 19 may work at different rotation angles of the driving device 9. For this purpose, distances between the working lever 25 in the neutral position and limit switches LSD and LSU are set to different values from each other, so that the limit switches LSD and LSU work at different timings from each other.

Figure 17B:
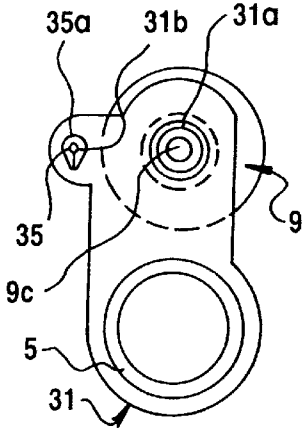
FIG. 17B is a right side view of the fifth embodiment of the present invention.
Figure 17C:
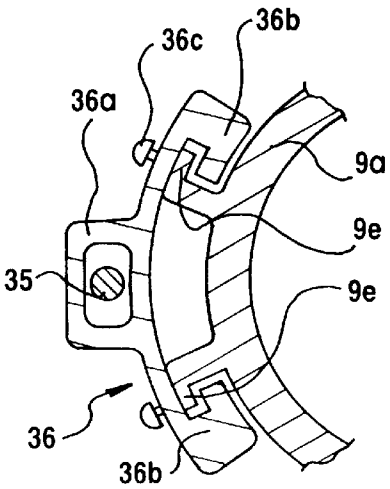
FIG. 17C is a cross section along A—A line in FIG. 17A.
Figure 17A:
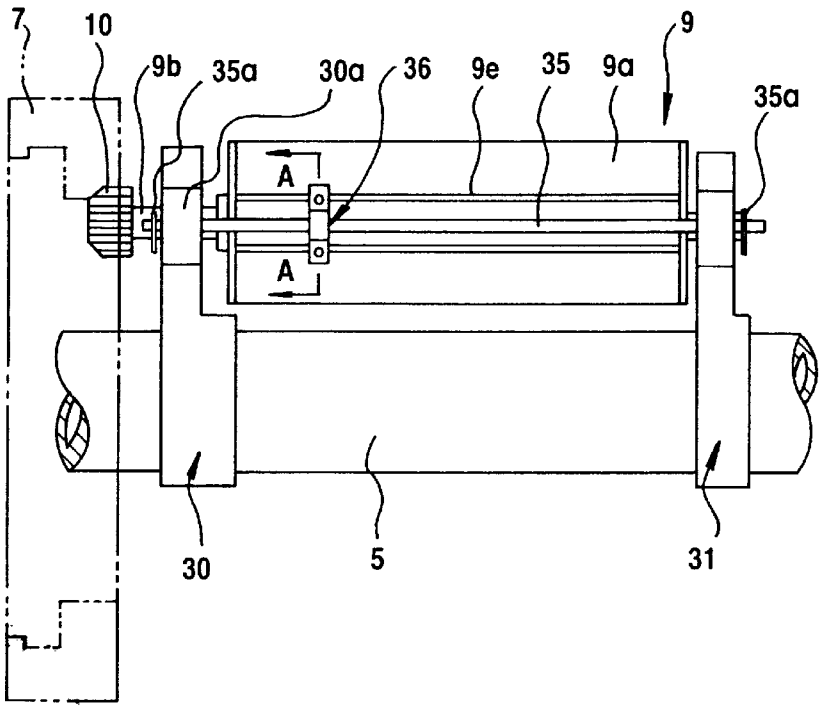
FIG. 17A is a front view of a fifth embodiment of the present invention.

Next, a fifth embodiment of the present invention will be explained with reference to FIG. 17. The apparatus of the embodiment includes first and second brackets 30, 31 that is fixed to the fixed shaft 5 and supports the extending output shaft 9*b* of the driving device 9 and the rear protruding shaft 9*c* respectively, and a load detecting spring 35 that is linear and is supported in a through hole (not shown in the figure) formed in the first and second brackets 30, 31. The load detecting spring 35 is put in a hole 35*a* formed in the engaging member 36 that can slide on and engage the casing slide engagement portion 9*e*. When the driving device 9 rotates relatively, the load detecting spring 35 generates spring force with engaged by the engaging member 36. By sliding the engaging member 36 on the casing 9*a*, the spring constant can be adjusted. The engaging member 36 has the same structure as in the third embodiment.

Numeral 35*a* is a stopper clip that prevents the load detecting spring 35 from dropping out of the first and second brackets 30, 31. The load detecting spring 35 is supported by the first and second brackets 30 with some clearance.

Figure 18B:
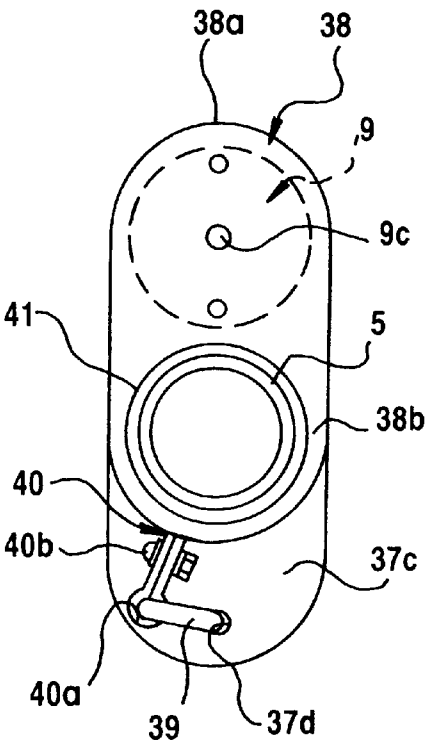
FIG. 18B is a right side view of the sixth embodiment of the present invention.
Figure 18A:
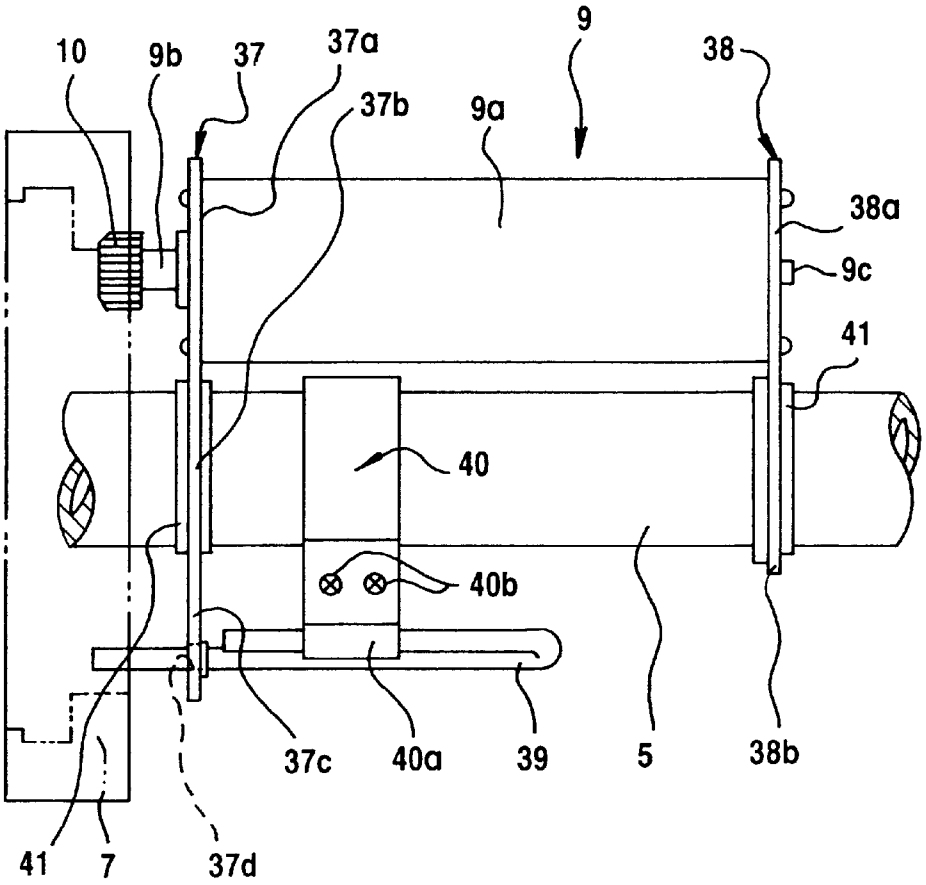
FIG. 18A is a front view of a sixth embodiment of the present invention.

Next, a sixth embodiment of the present invention will be explained with reference to FIG. 18. In this embodiment, driving device 9, which is the displaceable member changing the position in accordance with the load variation, changes the position around the axis of the fixed shaft 5.

In this embodiment, fixing portions 37*a* and 38*a* of first and second motor attachment plates 37 and 38 are fixed to both end surfaces of the driving device 9. Bearing portions

37*b* and 38*b* for the fixed shaft 5 are formed integrally in the first and second motor attachment plates 37 and 38, so that the driving device 9 can be supported rotatably around the fixed shaft 5. Thus, the driving device 9 can rotates around the axis of the fixed shaft 5. In addition, an extending portion 37*c* is provided to the first motor attachment plate 37. The extending portion 37*c* has a through hole 37*d* in which one end of U-shaped load detecting spring 39 can slide. Numeral 40 is a fixed bracket having an attachment portion 4*a* in which the other end of the load detecting spring 39 can slide. By loosening the screw 40*b*, the state of the load detecting spring 39 can be changed between fixing support and release states.

As mentioned above, driving device 9 is supported rotatably around the fixed shaft 5, and linked to the internally-toothed ring gear 7 via the output gear 10. Thus, the driving device 9 is supported in the neutral position in the normal operation of opening and closing the shutter curtain 1, so that the internally-toothed ring gear 7 is rotated in predetermined direction. When a large load is applied due to detection of an obstacle for example, driving device 9 rotates around the fixed shaft 5 against the spring power of the load detecting spring 39. On this occasion, the output gear 10 rotates along the internally-toothed ring gear 7. The rotation direction of the output gear 10 (the driving device 9) is the opposite of the predetermined direction of the internally-toothed ring gear 7 mentioned above. The rotation movement of the driving device 9 is detected by a detection sensor (not shown in the figure). Numeral 41 is a bushing provided to the bearing portion of the first and second motor attachment plate 37, 38 for the fixed shaft 5.

Thus, in the sixth embodiment, the driving device 9 as the displaceable member can rotate around the fixed shaft 5. The driving device 9 rotates around the fixed shaft 5 in accordance with excessive load applied to the driving device 9, so that the driving device 9 is stopped. In this embodiment too, adjustment of the spring constant of the load detecting spring 39 can be achieved by loosening the butterfly bolt 40*b* of the attachment portion 40*a* of the fixed bracket 40, sliding the load detecting spring 39 to an appropriate position, and fastening the butterfly bolt 40*b*, without any special adjustment member. Thus, simplification of the structure and the reduction of components can be achieved.

Figure 19:
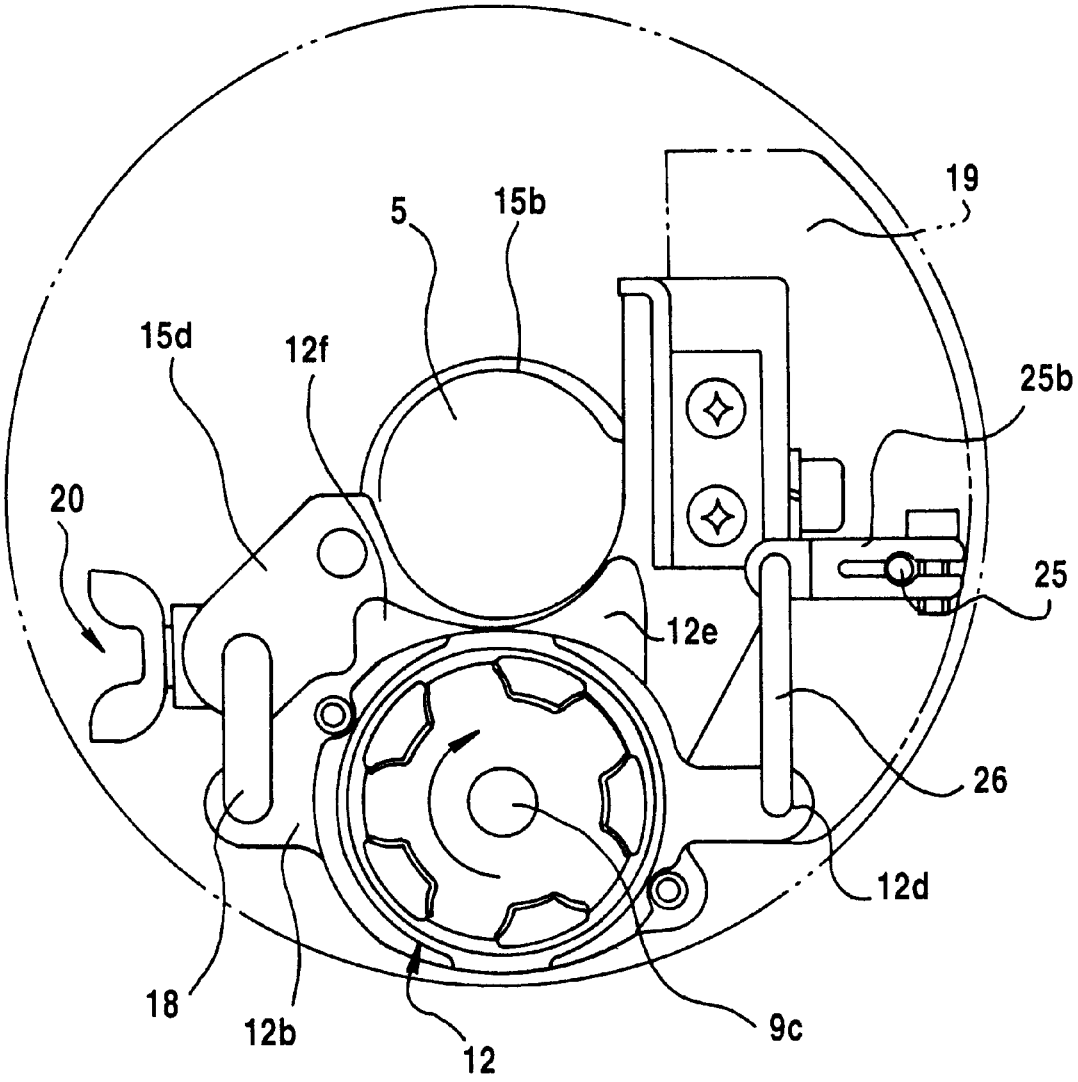
FIG. 19 is a side view of the driving device used in a seventh embodiment of the present invention.

Next, a seventh embodiment of the present invention will be explained with reference to FIG. 19. In this embodiment, a pair of protruding portions 16*e*, 16*f* is provided to the first holder. One protruding portion 16*e* abuts the fixed shaft 5 when excessive load is not applied to the driving device 9 (i.e., the non-working state or the neutral position of the first embodiment). Other structure is similar to the first embodiment). In this embodiment, since one protruding portion 12*e* abut the fixed shaft 5, the rotation movement of the driving device 9 in the arrow direction (rotation while closing the shutter curtain 1 in this embodiment) is permitted against the load detecting spring 18. However, the rotation movement in the opposite direction is restricted, so that the rotation can not performed in the opening operation. In this embodiment, stopping of the driving device 9 at the full opened state can be performed by combining other means such as open position detector.

In this structure, since the rotation movement of the driving device 9 in the counter-arrow direction is restricted at the non-working state, the spring force of the load detecting spring 18 is not required to be zero at the non-working state. Therefore, the spring force of the load detecting spring 18 can be applied to the driving device 9 in the counter-arrow direction (the driving device 9 can be supported with force to shift from the neutral position). Thus, rattle of the driving device 9 can be prevented.

What is claimed is:

1. An electrically-driven closure apparatus for a structure, comprising:

a closure member for opening and closing an opening in a structure;

a driving device having an electric motor, said closure member being opened and closed by a driving force of the driving device;

the electric motor or the driving device being a displaceable member which is rotatable relative to a fixed member fixed to the structure in accordance with a variation in a load experienced by the driving device;

a load detecting spring disposed between the displaceable member and the fixed member, exerting a spring force between the displaceable member and the fixed member; and a displacement sensor for detecting displacement of the displaceable member from a neutral position of the displaceable member;

wherein an effective spring constant of the load detecting spring is adjustable.

2. An electrically-driven closure apparatus for a structure according to claim 1, wherein the load detecting spring is formed substantially in a U-shape.

3. An electrically-driven closure apparatus for a structure according to claim 1, wherein the load detecting spring is formed substantially linearly.

4. An electrically-driven closure apparatus for a structure according to claim 1, wherein the displaceable member is rotatable around an axis of a motor shaft of the electric motor, and the displacement of the displaceable member in at least one direction in accordance with a load variation is detected by the displacement sensor.

5. An electrically-driven closure apparatus for a structure according to claim 2, wherein the displaceable member is rotatable around an axis of a motor shaft of the electric motor, and the displacement of the displaceable member in at least one direction in accordance with a load variation is detected by the displacement sensor.

6. An electrically-driven closure apparatus for a structure according to claim 3, wherein the displaceable member is rotatable around an axis of a motor shaft of the electric motor, and the displacement of the displaceable member in at least one direction in accordance with a load variation is detected by the displacement sensor.

7. An electrically-driven closure apparatus for a structure according to claim 1, wherein the displaceable member is supported rotatably by a fixed shaft to rotate around the axis of the fixed shaft, and the displacement of the displaceable member in at least one direction in accordance with a load variation is detected by the displacement sensor.

8. An electrically-driven closure apparatus for a structure according to claim 2, wherein the displaceable member is supported rotatably by a fixed shaft to rotate around the axis of the fixed shaft, and the displacement of the displaceable member in at least one direction in accordance with a load variation is detected by the displacement sensor.

9. An electrically-driven closure apparatus for a structure according to claim 3, wherein the displaceable member is supported rotatably by a fixed shaft to rotate around the axis of the fixed shaft, and the displacement of the displaceable member in at least one direction in accordance with a load variation is detected by the displacement sensor.

* * * * *